United States Patent [19]

Lin

[11] Patent Number: 4,920,910

[45] Date of Patent: May 1, 1990

[54] FOLDABLE DISPLAY MEANS

[76] Inventor: Chu-Ying Lin, P.O. Box 10160, Taipei, Taiwan

[21] Appl. No.: 291,668

[22] Filed: Dec. 29, 1988

[51] Int. Cl.[5] ..... G09F 17/00

[52] U.S. Cl. ..... 116/173

[58] Field of Search ..... 40/610, 611; 116/173–175, 303, 313; 248/514, 534, 539

[56] References Cited

U.S. PATENT DOCUMENTS

| | | | |
|---|---|---|---|
| 2,483,242 | 9/1949 | Smith | 211/1.3 |
| 3,119,370 | 1/1964 | Keats | 116/173 |
| 3,599,599 | 8/1971 | Jones | 116/173 |
| 3,941,250 | 3/1976 | Ott | 211/1.3 |
| 4,028,827 | 6/1977 | Hufton | 116/173 |
| 4,800,834 | 1/1989 | Feng | 116/173 |

FOREIGN PATENT DOCUMENTS

| | | | |
|---|---|---|---|
| 605011 | 10/1933 | Fed. Rep. of Germany | 116/173 |
| 66881 | 10/1957 | France | 40/334 |

*Primary Examiner*—William A. Cuchlinski, Jr.
*Assistant Examiner*—W. Morris Worth

[57] ABSTRACT

A foldable flag or display device includes a hollow handle, a flag or display sheet such as for advertising purposes, and a pole secured with the flag or display sheet pivotally mounted on the handle so that the pole can be folded into the hollow handle and the flag or display sheet is wound around the pole in the hollow handle for convenient storage or handling.

6 Claims, 3 Drawing Sheets

FOLDABLE DISPLAY MEANS

BACKGROUND OF THE INVENTION

J. W. Freeborn disclosed a flag cane in U.S. Pat. No. 696,957 having a flag 15 wound on a staff 5 which is telescopically stored in a cane 1. However, it is very inconvenient to retract the wound flag into a bore 2 in the cane 1 because the winding of the flag cloth on the staff 5 should be operated very carefully, and too loose winding of the flag may be obstructed beyond the top end of the cane 1.

The present inventor has found the drawback of Freeborn's prior art as aforesaid and invented the present foldable display means.

SUMMARY OF THE INVENTION

The object of the present invention is to provide a foldable display means having a display sheet such as a flag pivotally mounted on an upper end portion of a hollow handle formed with a longitudinal slit therein, the display sheet being folded into the hollow handle through the slit and wound in the hollow handle for a storage or handling.

DETAILED DESCRIPTION

Figure 1:
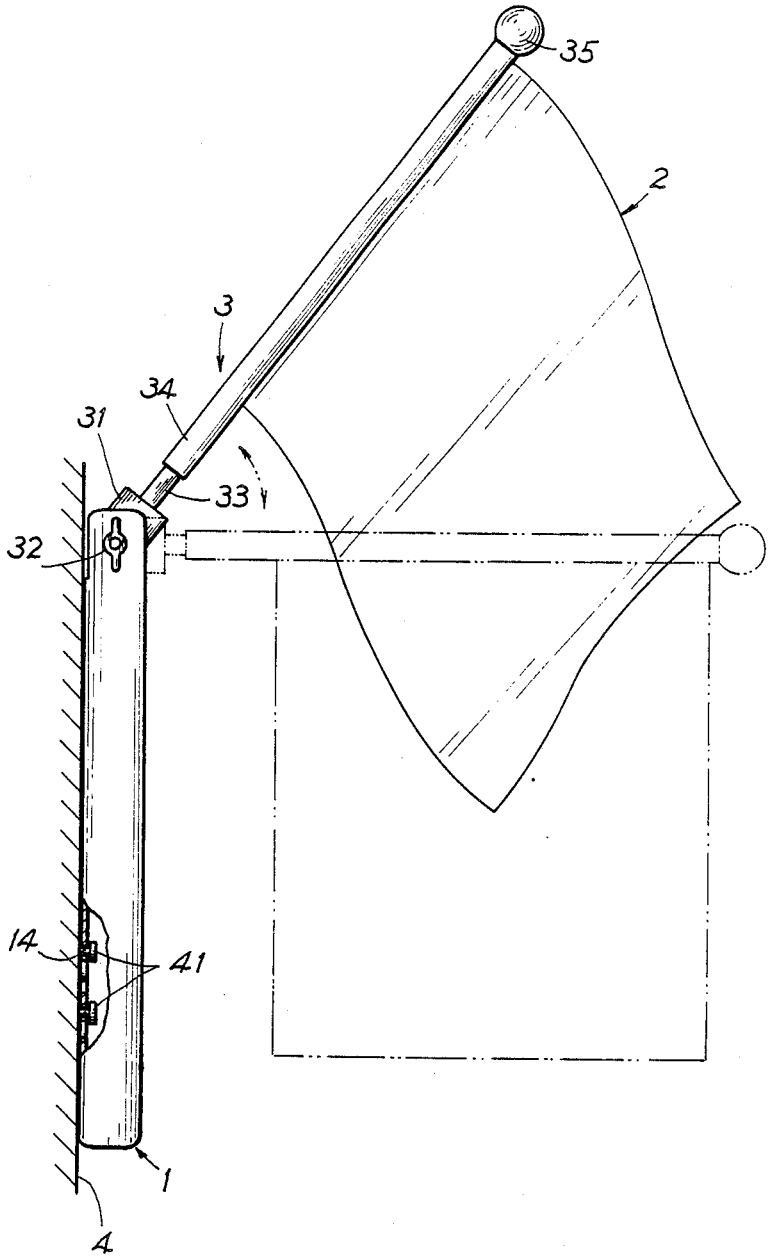
FIG. 1 is an illustration showing the present invention as extended.
Figure 2:
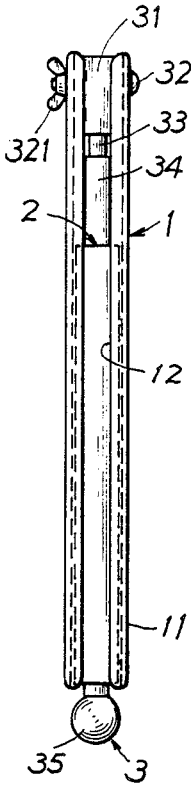
FIG. 2 is a side view of the present invention when folded.
Figure 3:
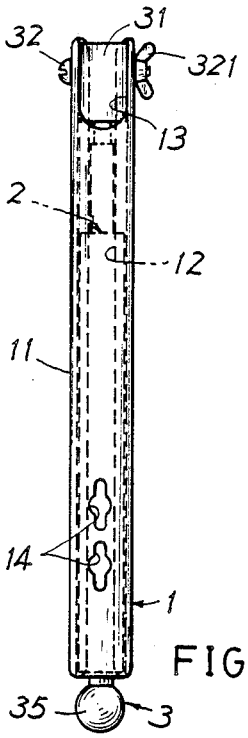
FIG. 3 is another side view of the present invention when viewed from a direction opposite to FIG. 2.

As shown in FIGS. 1–3, the present invention comprises: a hollow handle 1, a display sheet 2, and a pole means 3.

The hollow handle 1 is generally formed as a hollow pipe 11 having a cross section of a circular, an oval, a rectangular, a square or other polygonal shapes. The handle 1 is formed a longitudinal slit 12 through a full length of the pipe 11 as shown in FIG. 2 and formed with plural screw holes 14 in a back wall of the pipe 11 opposite to the slit 12 as shown in FIG. 3.

The display sheet 2 may be formed as a flag, a sheet of cloth, paper of the like for display or advertising purposes.

The pole means 3 includes: an adjusting block 31 pivotally mounted on an upper portion 13 of the handle 1 by a pivot means 32, a spindle 33 having its bottom end secured to the block 31, a reel pole 34 rotatably mounted on the spindle 33 and secured with the display sheet 2 thereon, and a head portion 35 secured on a top end of the pole 34 for holding the head portion 35 for rotatably winding the sheet 2 on the pole 34. The head portion 35 of the pole 34 operatively protrudes downwardly beyond a lower opening of the longitudinal slit 12 opposite to the upper portion 13 of the handle 1 when folding the pole 34 and the spindle 33 into the hollow handle 1.

The pivot means 32 may be a bolt pivotally mounting the block 31 on the handle 1 and adjustably locked by a butterfly nut 321 which can be operated to adjust the posing angle of the display sheet 2 as shown in FIG. 1.

The spindle 33 may sometimes be omitted and the pole 34 can be directly rotatably secured to the block 31 (not shown). By this way, the pole 34 may be poked through the block 31 to protrude downwardly so that someone may also rotate the pole 34 for winding the sheet 2. The pivot means 32 may also include a rotating knob (not shown) having ratchet teeth frictionally engageable with a corresponding ratchet surface formed on the handle 1 so that the pole can be optionally adjusted around the pivot means 32 for adjusting the posing angle of the pole 34 and display sheet 2 on the handle 1.

The present invention can be made as a portable type or may be fixed on a wall 4 as shown in FIG. 1 wherein the plural holes 14 of the handle 1 are engaged with corresponding screws or nails 41 secured on the wall 4.

When folding the present invention from FIG. 1 to FIG. 2 or 3, the reel pole 34 and the display sheet 2 are folded into the hollow pipe 11 through the longitudinal slit 12 and then the pole 34 is rotated to wind the sheet 2 on the pole 34 so that a folded display sheet 2 can be stored in the handle 1 for convenient storage or handling.

Figure 4:
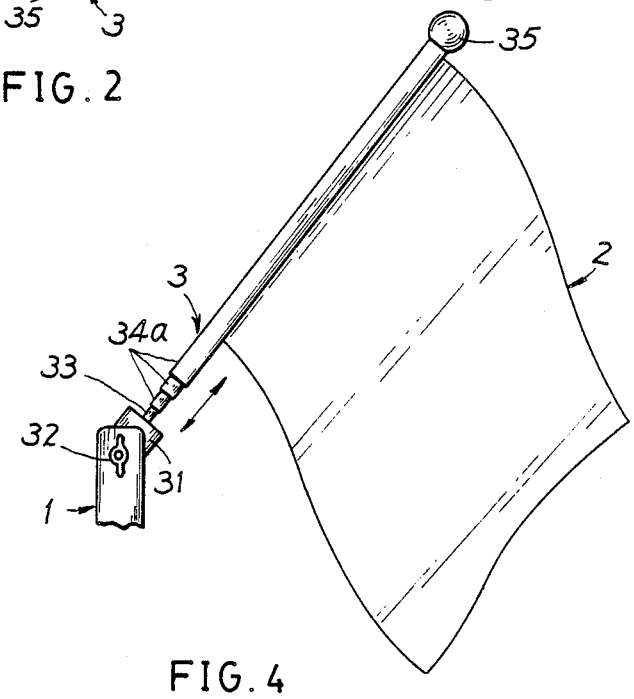
FIG. 4 shows another preferred embodiment of the present invention.

As shown in FIG. 4, the pole means 3 can be made as telescopic to include a plurality of pole sections 34*a* telescopically retractable or extendible with one another and the sheet 2 is fixed on an outermost pole section 34*a* of the pole means 3. The telescopic pole means 3 can be pulled outwardly from the handle 1 to unwind the display sheet 2, not pivotally extended through the slit 12, so that the width of the slit 12 can be reduced to enhance an esthetic meaning of the invention.

Figure 5:
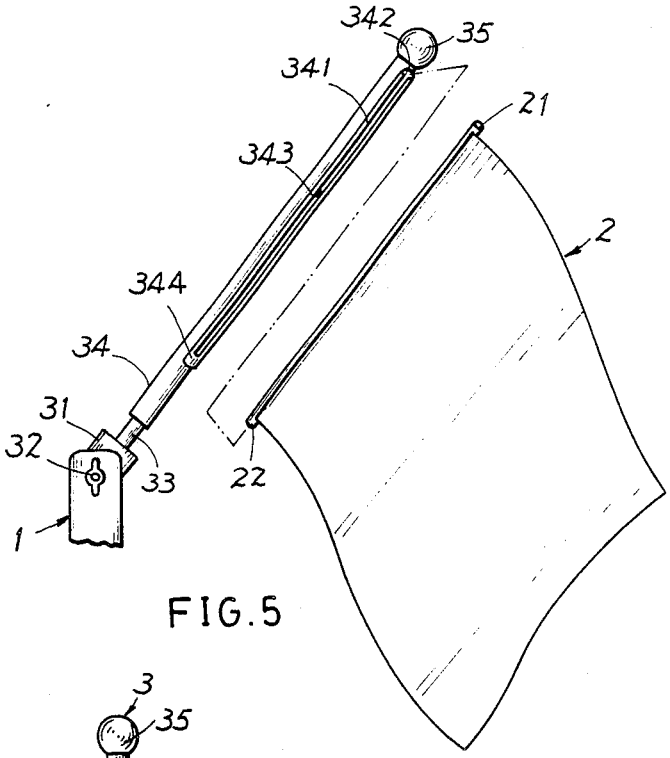
FIG. 5 shows still another preferred embodiment of the present invention.

As shown in FIG. 5, the pole 34 is further formed with a longitudinal holder 341 on a circumference of the pole 34 having a cross section of U shape, having a top opening 342 on a top end of the holder 341 and a longitudinal display slit 343 formed in the holder 341 and a bottom socket 344 formed on the bottom portion of the holder 341. The display sheet 2 is secured to a fixing rod 21 engageable with the longitudinal holder 341 on the pole 34 having a rod lower end portion 22 retained in the bottom socket 344 of the holder 341 so that the display sheet 2 extending outwardly through said slit 343 can be replaceably held in the holder 341. The display sheet 2 can be always changed or replaced with other display sheets having different features, figures or advertising contents shown on the sheet 2.

Figure 6:
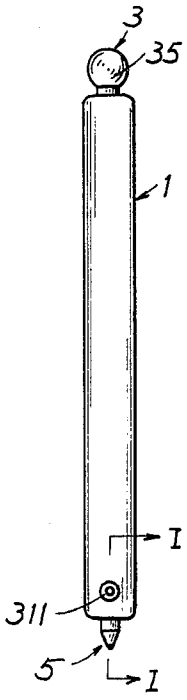
FIG. 6 shows further preferred embodiment of the present invention.
Figure 7:
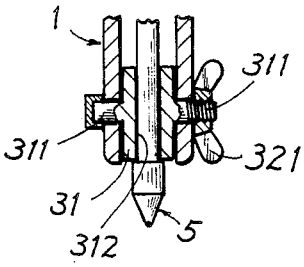
FIG. 7 is a partial side view of the present invention when viewed from I—I direction of FIG. 6.

As shown in FIGS. 6, 7, a pencil lead or an inner ink reservoir of a ball pen 5 is inserted in a central hole 312 of the block 31 having a pair of pins 311 protruding laterally to be pivotally mounted on one end portion 13 of the handle 1. For comfortable holding, the pins 311 should be made to be smooth without injuring an user's hand. Such a lead or ballpen reservoir 5 may serve for writing purpose.

The present invention has the following advantages superior to a conventional flag cane having a flag telescopically retracted into a cane:

1. The flag or display sheet 2 can be directly folded into the hollow handle 1 without first winding the sheet 2 on a pole 34. The sheet 2 can be wound on the pole when folded in the hollow handle 1 for a quick collapsing or folding operation of a flag or display sheet.

2. The flag or display sheet 2 can be optionally oriented around the pivot 32 on the handle 1 to adjust its posing angles for interesting or diversified practical uses.

3. The pole means 3 can be made as telescopic type for longer or shorter services, and the block 31 can be inserted with a pencil lead or ballpen inner reservoir 5 for further writing purpose.

The handle 1 may be formed with two longitudinal slits 12 on two opposite sides of the hollow pipe so that the pole means 3 and the display sheet 2 can be pivotally foldably stored into the hollow pipe 11 from either a right direction or a left direction. Naturally, a retainer or cap should be provided on one end of the pipe 11 opposite to the pivot means 32 to hold the outer end of the pole 34.

I claim:

1. A foldable display means comprising:

a hollow handle generally formed as a hollow pipe having a longitudinal slit longitudinally formed in said hollow pipe;

a display sheet selected from a flag, a cloth or paper sheet for advertising uses; and a pole means pivotally secured to said hollow handle through a pivot means formed on an upper portion of said handle, having said display sheet secured on said pole means, said pole means being pivotally folded around said pivot means into said hollow handle through said longitudinal slit and said display sheet being wound around said pole means in said hollow handle;

the improvement which comprises:

said pole means including a head portion secured on a top end of said pole means having said head portion protruding downwardly beyond a lower opening of said longitudinal slit opposite to said upper portion of said handle when folding said pole means into said handle, whereby upon a rotation of said head portion of said pole means, said display sheet will be wound on said pole means in said hollow handle.

2. A foldable display means according to claim 1, wherein said pole means includes an adjusting block pivotally secured by said pivot means to an upper portion of said handle, a spindle having a lower end portion of the spindle secured to said block, a reel pole having said display sheet secured on said pole rotatably mounted on said spindle, and said head portion of said pole means secured on a top end of said pole.

3. A foldable display means according to claim 2, wherein said pivot means includes a butterfly nut adjustably fixing a bolt pivotally securing said pole means on said handle.

4. A foldable display means according to claim 1, wherein said pole means includes a spindle secured with said display sheet thereon, said spindle rotatably mounted in a central hole formed in said adjusting block pivotally secured to said handles, said head portion of said pole means secured on a top end of said spindle.

5. A foldable display means according to claim 1, wherein said pole means includes a plurality of pole sections telescopically retractable or extandable with one another rotatably mounted on a spindle secured to an adjusting block pivotally secured to said handle, having an outermost pole section secured with said display sheet thereon, said head portion of said pole means secured on a top end of said outermost pole section.

6. A foldable display means comprising:

a hollow handle generally formed as a hollow pipe having a longitudinal slit longitudinally formed in said hollow pipe;

a display sheet selected from a flag, a cloth or paper sheet for advertising uses; and a pole means having an adjusting block pivotally secured to said hollow handle through a pivot means formed on an upper portion of said handle, having said display sheet secured on said pole means, said pole means being pivotally folded around said pivot means into said hollow handle through said longitudinal slit and said display sheet being wound around said pole means in said hollow handle;

the improvement which comprises:

said pole means including a head portion secured on a top end of said pole means having said head portion protruding downwardly beyond a lower opening of said longitudinal slit opposite to said upper portion of said handle when folding said pole means into said handle, whereby upon a rotation of said head portion of said pole means, said display sheet will be wound on said pole means in said hollow handle; and said adjusting block inserted with a pencil lead or an inner ink reservoir of a ball pen in said block for writing use.

* * * * *